US005906371A

United States Patent [19]

Peterson

[11] Patent Number: 5,906,371

[45] Date of Patent: May 25, 1999

[54] MULTI-SKILL BOARD GAME

[76] Inventor: Robert N. Peterson, 7777 Main St., Bear Lake, Mich. 49614

[21] Appl. No.: 09/031,448

[22] Filed: Feb. 27, 1998

[51] Int. Cl.[6] ..... A63F 3/00

[52] U.S. Cl. ..... 273/249; 273/243

[58] Field of Search ..... 273/242, 243, 273/248, 249

[56] References Cited

U.S. PATENT DOCUMENTS

| | | | |
|---|---|---|---|
| 3,939,578 | 2/1976 | Coffey | 273/249 |
| 4,121,823 | 10/1978 | McBride | 273/249 |
| 4,124,214 | 11/1978 | Pavis | 273/249 |
| 4,557,485 | 12/1985 | Lardon | 273/249 |
| 5,145,184 | 9/1992 | Yearick et al. | 273/248 |
| 5,295,834 | 3/1994 | Saunders | 273/249 X |
| 5,738,354 | 4/1998 | Easley | 273/249 |

*Primary Examiner*—William E. Stoll
*Attorney, Agent, or Firm*—Floyd Scheier

[57] ABSTRACT

A multi-skill question and answer board game which can be competitively and simultaneously played by players of different skill and age levels comprising a game board with a one directional playing track along which each player moves their pieces based upon the value of the roll of a single die, the track is made up of plurality of different topic sectors, a number of sets of multi-skill level topic cards bearing questions for each topic to which each player must reply once he has chosen the skill level, the higher the skill level chosen the higher value given to the correct answer.

20 Claims, 1 Drawing Sheet

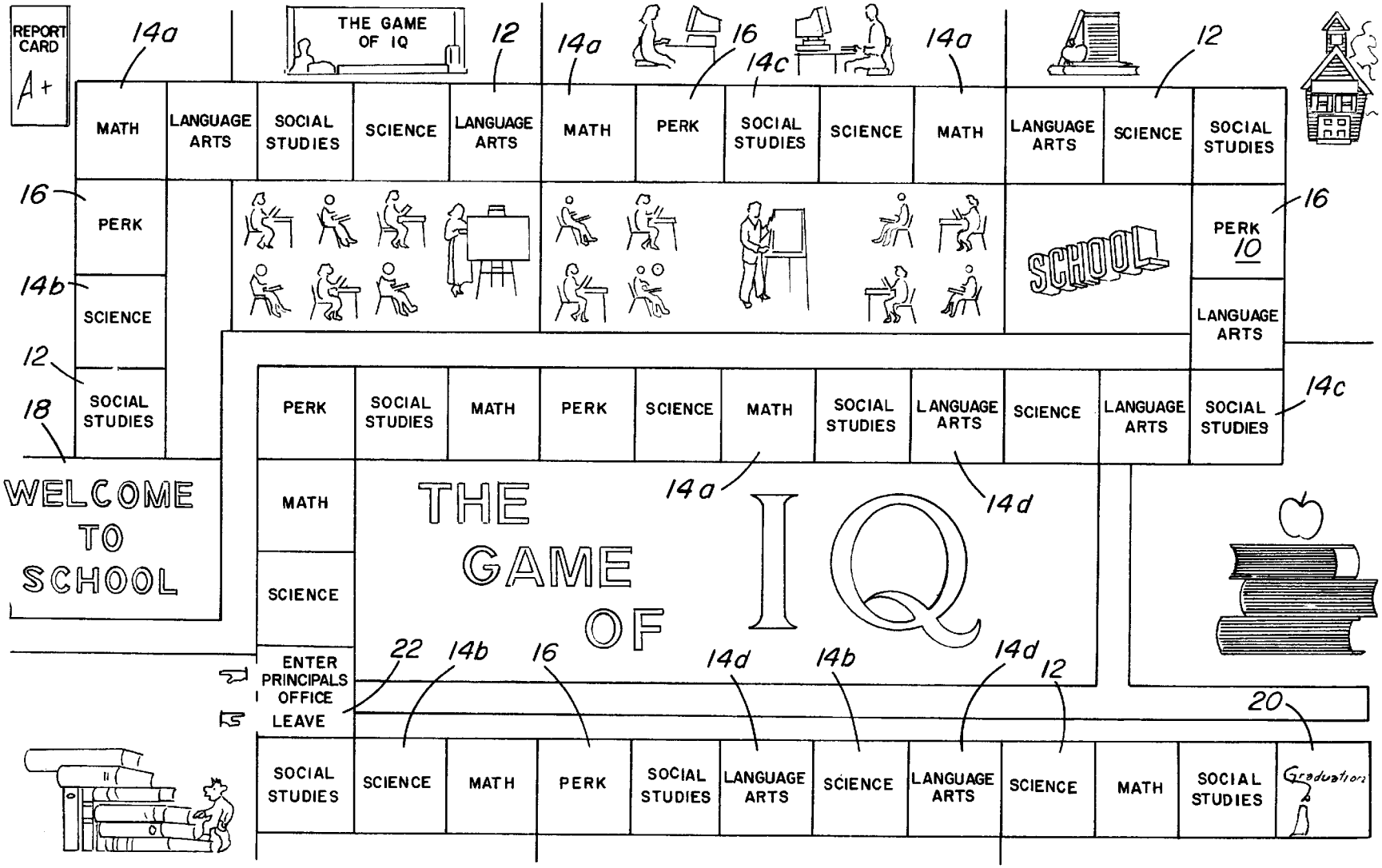
THE GAME OF IQ
SCHOOL
WELCOME TO SCHOOL
REPORT CARD
A+
THE GAME OF IQ
MATH
SCIENCE
LANGUAGE ARTS
SOCIAL STUDIES
PERK
ENTER PRINCIPALS OFFICE
LEAVE
Graduation
12
14a
14b
14c
14d
16
18
20
22

MULTI-SKILL BOARD GAME

FIELD OF THE INVENTION

The invention relates generally to a multi-skill question and answer board game which can be competitively and simultaneously played by players of different skill and age levels comprising a game board with a one directional playing track along which each player moves their pieces based upon the value of the roll of a single die, the track is made up of plurality of different topic sectors, a number of sets of multi-skill level topic cards bearing questions for each topic to which each player must reply once he has chosen the skill level, the higher the skill level chosen the higher value given to the correct answer.

It is therefor an objective of this invention to provide a educational board game that can be played by children and adults which will tend to improve the player's skills in the several topics of math, science, social studies and language arts; all in a fun-filled and educational environment.

It is another important objective of this invention to provide a educational board game that can be inexpensively manufactured and is suitable for play in the classroom and home environment. It yet another important objective of this invention to provide a educational board game that can readably be adapted to a computer-based format.

PRIOR ART

The prior art is replete with all types of educational board games; none of which posses the unique and innovative character of the game of the present invention including a multi-skill question and answer board game which can be competitively and simultaneously played by players of different skill and age levels.

None of the prior art board games allow for the players to move their pieces along a one directional playing track based upon the value of the roll of a single die; the track being made up of thirty-six topic sectors including math, science, social studies and language arts.

The game of the present invention, as distinguished from the prior art, includes a number of sets of multi-skill level topic cards bearing questions for each topic to which each player must reply once he has chosen the skill level, the higher the skill level chosen the higher value given to the correct answer. Examples of such prior art includes U.S. Pat. Nos. 4,368,889, 4,557,485, 4,714,254, 5,308,077, 5,332,227, 5,342,056, 5,405,150, 5,429,369 and 5,454,569.

Similarly, the prior art also includes such board games as "SCRABBLE", "JUNIOR TRIVIA" and "GO TO THE HEAD OF THE CLASS"(Trademarks of the Milton Bradley Company).

BRIEF DESCRIPTION OF THE DRAWING

The above and other objects, features and advantages will be more clearly understood and appreciated from the following Detailed Description of the Preferred Embodiment of the present invention when taken in conjunction with the accompanying single Figure which illustrates the game board of the present invention.

The associated parts may include a standard die (not shown) and several sets of "topic" cards (also not shown) all of which will be further discussed below.

DESCRIPTION OF THE PREFERRED EMBODIMENT

Referring now to the sole FIGURE there is shown a game board 10 with a one directional playing track 12 along which each player moves their pieces (not shown) based upon the value of the roll of a single die (not shown). The die could be any standard six sided die. Other methods of randomly selecting a number for moving the pieces could readily used in lieu of the die as, for example, a spinning arrow or the like mounted on a board with numbers indexed to the arrow.

The playing pieces could take any suitable form such as a figure of a person and could be made from any suitable material. The form and material of the pieces are not material to the invention.

The track 12 is made up of thirty-six topic sectors or spaces 14 including, eight math spaces 14*a*, ten science spaces 14*b*, ten social studies spaces 14*c* and eight language arts spaces 14*d*. The track 12 is also made up of six Perk spaces 16, a Welcome to School space 18, a Graduation space 20 and a Principal's Office space 22.

A player that lands on one of the thirty-six topic spaces 14*a*–14*d* must answer a question on a randomly selected card from a set of multi-skill level topic question-answer cards (not shown) for that specific topic. For example, if a player lands on a math space 14*a*, he must answer a question from a randomly selected math question-answer card at a chosen skill level. The questions are presented on one side of the card with the corresponding answer being on the opposite side of the card with a suitable explanation when appropriate. The cards could be color coded for each skill level and be made from any suitable material and sized for easy handling by each of the players.

The player can choose from four skill levels starting at the Elementary School level (5 I.Q. points for the correct answer) being the lowest degree of difficulty and progressing through Junior High School level (10 I.Q. points for the correct answer), High School level (15 I.Q. points for the correct answer) and College level (20 I.Q. points for the correct answer) the College level being the highest degree of difficulty.

There could be a total of four hundred question-answer cards equally divided in one hundred card sets among each of the four topics presented on the board 10 (i.e. math, language arts, social studies and science). Each one hundred topical card set could be further divided into twenty-five card sets among each of the four skill levels (i.e. Elementary School, Junior High School, High School and College).

To compensate for any age differences between each of the players, each player is assigned an age factor which is applied against their I.Q. point total (by multiplying the age factor by the I.Q. point total) to determine the player's total I.Q. value which is is used to determine the winner of the game.

There are four Age Factors starting at ages 7–10 (Age Factor 3) and progressing through ages 11–13 (Age Factor 2), ages 14–17 (Age Factor 1.75) and ages 18 and over (Age Factor 1.50). For example, a player who is 11 years old and answers a Junior High School question correctly will receive 20 I.Q. points (i.e. skill level 10×Age Factor 2=20 I.Q. points).

The questions that might be found on the Math question-answer cards might relate to addition, subtraction, multiplication, division, whole, fraction, decimal, unknown, and exponent numbers, area, circumference, volume formulas, word and story problems and other comparable subject categories.

Examples of the questions that may be found on the Math question-answer cards might be as follows:

ELEMENTARY SCHOOL

Question: Add 0.007+32.4+1.234+7.3=

Multiple Choices:

(a) 41.941

(b) 40.841

(c) 40.931

(d) 40.941

Answer: (d) 40.941 [32.4
7.3
1.234
.007
40.941]

JUNIOR HIGH SCHOOL

Question: 12 is ¾ of what number?

Multiple Choices:

(a) 16

(b) 9

(c) 36

(d) 20

(e) 15

Answer: (a) 16 [¾=0.75; 12/0.75=16]

HIGH SCHOOL

Question: If a car drives 25 miles on two gallons of gasoline, how many gallons will be needed for a trip of 150 miles?

Multiple Choices:

(a) 12

(b) 3

(c) 6

(d) 7

(e) 10

Answer: (a) 12 [25/2 = 150/Gal.
12.5 = 150/Gal.
Gal. = 150/12.5
Gal. = 12]

COLLEGE

Question: If the radius of a circle is decreased by 10% by what percent is its area decreased?

Multiple Choices:

(a) 10

(b) 19

(c) 21

(d) 79

(e) 81

Answer: (b) 19% [If the radius of the two circles have a ratio of 10:9, the areas have a ratio of 100:81; therefore the decrease is 19 out of 100; or 100]

The questions that might be found on the Language Arts question-answer cards might relate to word and language usage, common abbreviations, acronyms, synonyms, antonyms, analogies, double meanings, double word usage and other comparable subject categories.

Examples of the questions that may be found on the Language Arts question-answer cards might be as follows:

ELEMENTARY SCHOOL

Question: All of the following are nouns except?

Multiple Choices:

(a) teacher (b) city (c) democracy (d) desk (e) friendly

Answer: (e) friendly [adverb]

JUNIOR HIGH SCHOOL

Question: There are two types of adjectives: Descriptive and Limiting elect the descriptive from the following words.

Multiple Choices:

(a) six (b) my (c) short (d) our

Answer: (c) short [descriptive adjective indicates a nouns quality or condition; e.g. the plant had short roots.]

HIGH SCHOOL

Question: Synonyms: find the synonym of easy.

Multiple Choices:

(a) elementary (b) artful (c) infantile (d) pretensions (e) well

Answer: (a) elementary

COLLEGE

Question: Antonyms: find the Antonym of hideous.

Multiple Choices:

(a) normal (b) generous (c) handsome (d) fair (e) logical

Answer: (c) handsome

The questions that might be found on the Social Studies question-answer cards might relate to important historical dates particularly relating to American history, Presidents of the United States, great events in world history, world exploration and discovery, inventions and inventors, major world cities and facts and royal rulers of Europe and Asia and other comparable subject categories.

Examples of the questions that may be found on the Social Studies question-answer cards might be as follows:

ELEMENTARY SCHOOL

Question: The Panama Canal allows ships to pass between the _____ Oceans.

Multiple Choices:

(a) Atlantic/Pacific (b) Atlantic/Artic (c) Atlantic/Indian (d) Pacific/Indian

Answer: (a) Atlantic/Pacific [One of the greatest engineering feats in the world, making it possible to sail between the Atlantic and Pacific Oceans.]

JUNIOR HIGH SCHOOL

Thomas Jefferson was instrumental in the buying what famous U.S. land?

Multiple Choices:

(a) District of Columbia (b) The Louisiana Purchase (c) Florida (d) New York City Answer: (b) The Louisiana Purchase [The land was bought from France in 1803 doubling the United States land holdings.]

HIGH SCHOOL

Question: What do John Adams, John Hancock, Benjamin Franklin, and George Washington have in common; they are all signers of the:

Multiple Choices:

(a) U.S. Constitution (b) Getysburg Address (c) Declaration of Independence (d) Articles of Mayflower (e) Pledge of Allegiance Answer: (c) Declaration of Independence.

COLLEGE

Question: All of the countries ruled Cyprus at one time, except:

Multiple Choices:

(a) Great Britain (b) Turkey (c) Greece (d) Bolivia

Answer: (d) Bolivia [Greece in ancient times; Great Britain (1878) and Turkey (1974).]

The questions that might be found on the Science question-answer cards might relate to basic formulas of physics, facts and terms of chemistry, facts about the planets, life sciences (e.g. biology, zoology, botany, taxonomy), human body (e.g. nervous, circulatory, digestive, respiratory, immune and reproductive systems) and earth sciences (e.g. geology, oceanography and paleontology) and other comparable subject categories.

Examples of the questions that may be found on the Science question-answer cards might be as follows:

ELEMENTARY SCHOOL

Question: How many known planets are in our solar system?

Multiple Choices:

(a) 9

(b) 12

(c) 7

(d) 20

Answer: (a) 9 [Mercury, Venus, Earth, Mars, Jupiter, Saturn, Uranus, Neptune and Pluto]

JUNIOR HIGH SCHOOL

Question: Which chemical element is part of all living things?

Multiple Choices:

(a) carbon (b) lead (c) tin (d) zinc

Answer: (a) carbon

HIGH SCHOOL

Question: What is the most frequent cause of major earthquakes?

Multiple Choices:

(a) faulting (b) folding (c) land slides (d) submarine currents (e) tsunamis

Answer: (a) faulting [rapid movement of rock masses below the earth surface]

COLLEGE

Question: Carbon dioxide enters a plant by way of the:

Multiple Choices:

(a) roots (b) xylem (c) plasma membrane (d) stomata (e) intercellular spaces

Answer: (d) stomata [One of the minute orifices or slits in the epidermis of leaves]

Referring to the other spaces found on the board 10, the Perk spaces 16 allow the player landing thereon to choose among any of the above noted four topics (i.e. math, science, social studies and language arts) at a chosen skill level.

The Welcome to School space 18 is the space where all of the players place their game piece at the start of the game.

The Principal's Office space 22 is the space where, if a player lands thereon, loose their turn to advance. The player so positioned on the Principal's Office space 7 must, during one of their next two turns, roll three odd or three even die numbers in a row. If they fail then on their third turn they may advance their piece based on the die value rolled.

The Graduation space 20 is the end space of the game. The first player to reach this space with highest of I.Q. value (the method of calculation of I.Q. value is as described above) is the winner of the game. If the first player who reaches this space has a lower I.Q. value than a player still on the track 2 then the game will proceed until a player reaches the Graduation space with the highest I.Q. value.

In summary, it can be seen from the above description of the board game in accordance with the present invention, that the game is easy and fun to play and will reinforce the player's interest in the various important topics. The flow of the game is simply structured without unnecessary and complicated rules thus making it particularly adaptable to the classroom environment. The game could readily be adapted to computer applications which would also be useful as a teaching tool.

It should be noted that, while particular examples of the present invention have been shown and described, it is apparent that changes and modifications may be made therein without departing from the invention in its broadest aspects. The aim and purpose of the appended claims, therefore, is to cover all such changes and modifications as fall within the true spirit and scope of the invention.

I claim:

1. A multi-skill question and answer board game which can be competitively and simultaneously played by players of different skill and age levels comprising a game board with a one directional playing track along which each player moves their pieces based upon a randomly selected value, said track is made up of a plurality of different topic sectors, a number of sets of multi-skill level topic cards corresponding to each of said topic sectors bearing questions for each topic to which each player must reply once he has chosen the skill level, the higher the skill level chosen the higher point value given to the correct answer, and a list of age factors to compensate for any age differences between each of the players, said age factor is applied against their point total to determine the overall winner of the game.

2. A multi-skill question and answer board game according to claim 1 wherein a player that lands on one of the plurality of said topic spaces must correctly answer a question on a randomly selected card from said set of multi-skill level topic question-answer cards for that specific topic.

3. A multi-skill question and answer board game according to claim 1 wherein said randomly selected value to move each said players pieces is determined by the value of the roll of a single die by each player during that players sequential turn.

4. A multi-skill question and answer board game according to claim 1 wherein the point value given to the correct answer is expressed in terms of I.Q. points and said age factor is applied against their respective I.Q. point total by multiplying the age factor by the I.Q. point total to determine each said player's total I.Q. value which is used to determine the winner of the game.

5. A multi-skill question and answer board game according to claim 4 wherein there are are four Age Factors with ages 7–10 being assigned an Age Factor of 3, ages 11–13 being assigned an Age Factor of 2, ages 14–17 being assigned an Age Factor of 1.75 and ages 18 and over being assigned an Age Factor of 1.50.

6. A multi-skill question and answer board game according to claim 5 wherein each player can choose from four skill levels starting at the Elementary School level being the lowest degree of difficulty and progressing through Junior High School level, High School level and College level, the College level being the highest degree of difficulty.

7. A multi-skill question and answer board game according to claim 6 wherein Elementary School level is assigned 5 I.Q. points for the correct answer, Junior High School level is assigned 10 I.Q. points for the correct answer, High School level is assigned 15 I.Q. points for the correct answer and College level is assigned 20 I.Q. points for the correct answer.

8. A multi-skill question and answer board game according to claim 1 wherein said track is made up of thirty-six topic sectors including math, science, social studies and language arts.

9. A multi-skill question and answer board game according to claim 8 wherein said thirty-six topic sectors include eight math spaces, ten science spaces, ten social studies spaces and eight language arts spaces.

10. A multi-skill question and answer board game according to claim 1 wherein the questions are presented on one side of said multi-skill level topic question-answer cards with the corresponding answer being on the opposite side of said card.

11. A multi-skill question and answer board game according to claim 10 wherein said multi-skill level topic question-answer cards are color coded for each skill level.

12. A multi-skill question and answer board game according to claim 10 wherein said multi-skill level topic question-answer cards include a total of four hundred question-answer cards equally divided in one hundred card sets among each of said four topic sectors.

13. A multi-skill question and answer board game according to claim 12 wherein each one hundred topical card set is divided into twenty-five card sets among each of said skill levels.

14. A multi-skill question and answer board game according to claim 1 wherein said one directional playing track further includes a Welcome to School space which corresponds to the starting point of said one directional playing track and a Graduation space which corresponds to the end point of said one directional playing track.

15. A multi-skill question and answer board game according to claim 14 wherein the first player to reach said Graduation space with highest overall point value is the winner of the game.

16. A multi-skill question and answer board game according to claim 1 wherein said one directional playing track further includes a plurality of Perk spaces interspersed among said topic sectors, said Perk spaces allow the player landing thereon to choose among any of said topics.

17. A multi-skill question and answer board game according to claim 16 wherein said one directional playing track includes six Perk spaces.

18. A multi-skill question and answer board game according to claim 1 wherein said one directional playing track further includes a Principal's Office which when a player lands thereon, lose their respective turn to advance.

19. A multi-skill question and answer board game according to claim 18 wherein a player so positioned on the Principal's Office space must, during their next two turns, roll three odd or three even die numbers in a row, failing on their third turn they may advance their piece based on the die value rolled.

20. The method of playing a multi-skill question and answer board game which can be competitively and simultaneously played by players of different skill and age levels comprising the steps of:

providing a game board with a one directional playing track along which each player moves their pieces based upon a randomly selected value, said track is made up of a plurality of different topic sectors, providing a number of sets of multi-skill level topic cards corresponding to each of said topic sectors bearing questions for each topic to which each player must reply once he has chosen the skill level, the higher the skill level chosen the higher point value given to the correct answer, assigning to each player an age factor to compensate for any age differences between each of the players, applying said age factor is against their point total to determine the overall winner of the game.

* * * * *